United States Patent [19]

Loveland

[11] 4,388,694

[45] Jun. 14, 1983

[54] CIRCUITRY FOR SIMULTANEOUSLY PERFORMING INTEGRATION AND DIVISION

[75] Inventor: Robert S. Loveland, West Covina, Calif.

[73] Assignee: The Perkin-Elmer Corp., Norwalk, Conn.

[21] Appl. No.: 254,803

[22] Filed: Apr. 16, 1981

[51] Int. Cl.[3] ..... G06G 7/18; G06G 7/16

[52] U.S. Cl. ..... 364/834; 307/498; 328/127; 364/841; 364/850

[58] Field of Search ..... 364/829, 834, 841, 849, 364/850; 328/127, 160, 161, 158; 307/490, 498

[56] References Cited

U.S. PATENT DOCUMENTS 3,624,643 11/1971 Richman ..... 364/834 X 4,059,751 11/1977 Eriksson ..... 364/829

4,122,528 10/1978 Rieger ..... 364/834 X 4,158,234 6/1979 Grandchamp ..... 364/834

*Primary Examiner*—Joseph F. Ruggiero

*Attorney, Agent, or Firm*—S. A. Giarratana; T. P. Murphy; J. R. Dwyer

[57] ABSTRACT

The disclosed circuitry for integrating an analog voltage signal with respect to time, t, while simultaneously dividing the integral by time, t, is valuable for use in medical pulmonary analyzers and includes a ramp generator for developing a voltage level proportional to time, a duty cycle modulator for generating an inverted time signal, 1/t, a multiplier for multiplying the analog voltage signal, V, by the inverted time signal, 1/t, followed by an integrator to produce the required output of $1/t \int V\,dt$.

6 Claims, 2 Drawing Figures

CIRCUITRY FOR SIMULTANEOUSLY PERFORMING INTEGRATION AND DIVISION

BRIEF SUMMARY OF THE INVENTION

This invention relates to circuitry for performing a mathematical equation and specifically to circuitry for dividing by time, t, a voltage representing an analog quantity that is simultaneously being integrated with respect to time, t.

The requirement for such circuitry may appear somewhat limited but it is most important and valuable for certain applications. For example, medical pulmonary analyzers employ mass spectrometers, the output signals from which may be multiplied by a signal voltage representing flow of various respiratory gases measured during the duration of a patient's breathing cycle. This product is then integrated with respect to time and is then divided by the time period of the breath cycle as part of analyses for obtaining various data such as oxygen uptake, carbon dioxide production, minute ventilation, respiratory exchange quotient, or other measurements as a function of respiratory rate.

The process of both integrating and dividing has heretofore been separately performed; however, the results have generally been inaccurate and unsatisfactory. For example, assume a small quantity is being divided by time, t. As "t" increases, the output signal gets smaller and smaller, making it increasingly difficult to accurately measure the desired quantity. A similar problem also arises with a separate integration computation in which an analog value is being integrated with respect to time. As time progresses from zero to "t", the integrated value gets larger and larger until the limit of the electronic circuitry is exceeded and it ceases to function as an integrator. Thus, the heretofore accepted method of computation comprising the multiplication of the results of the separate computations of "1/t" and the integration of an analog quantity with respect to time, t, is subject to severe limitations and errors.

The circuitry of the invention takes advantage of the fact that the quotient of the division operation decreases with time, t, as the product of the integration operation increases with time, t, to thereby cancel the error effects of the variable, t. The circuitry of the invention performs both division and integration operations simultaneously to yield the required function. In addition to maintaining a response within the limitations of the electronic circuitry, an additional advantage is that the drift errors usually associated with integrators caused by amplifier leakage and offset are also essentially eliminated, since the integrated errors, which increase with time, are cancelled out by the circuitry which decreases the error with respect to time.

Briefly discussed, the circuitry of the invention includes means for simultaneously computing the product of the quotient, 1/t, and the integral of an analog value, V, with respect to time. A ramp generator controls the "on-to-off" cycling of a duty cycle modulator operating from a 10 KHz frequency source to produce an output signal inversely proportional to the ramp signal and thus inversely proportional to time, t. The same duty cycle signal is supplied to a multiplier located between the input signal amplifier and an output integrator. The multiplier then operates to multiply the amplified input signal by the value 1/t, which is then integrated to provide the desired output of $1/t \int V dt$.

BRIEF DESCRIPTION OF THE DRAWINGS

In the drawings which illustrate preferred circuitry of the invention.

DETAILED DESCRIPTION

Figure 1:
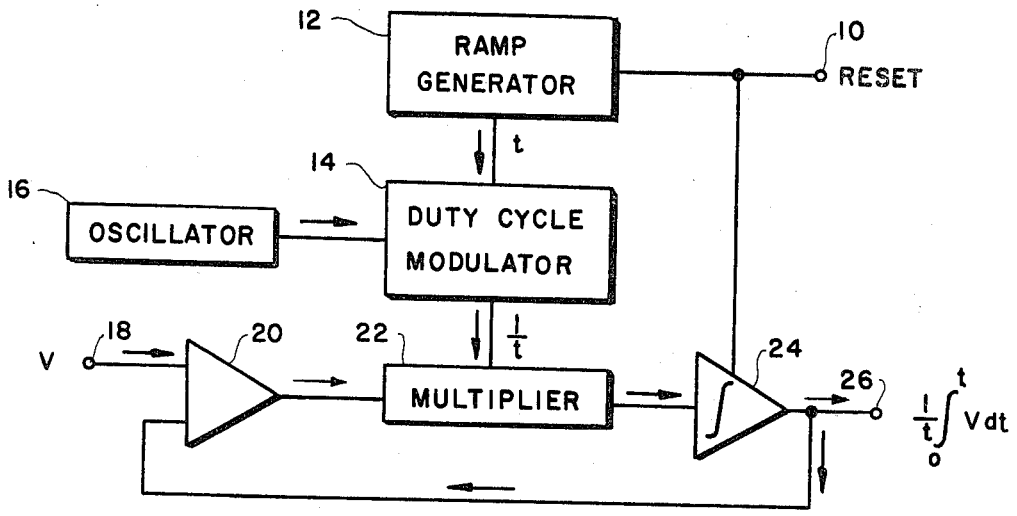
FIG. 1 is a block diagram of the circuitry of the invention.

The block diagram of FIG. 1 illustrates the basic circuitry components for performing a simultaneous integration and division operation. An input signal to the reset terminal 10 starts the ramp generator 12 which, in the preferred embodiment for use with pulmonary gas analysis equipment, generates an output ramp of 0.5 volts per second. The ramp output signal which represents time, t, is used to control the on-to-off duty cycle of the duty cycle modulator 14 which operates in connection with an oscillator 16 as will be subsequently explained in connection with FIG.2. The various components within the duty cycle modulator 14 are selected so that the output duty cycle is proportional to the ratio, 1/t.

An analog voltage signal, V, which, as previously discussed, may be the output signal from a mass spectrometer, is applied to the input terminal 18 of an operational amplifier 20, the output of which is applied to a multiplier 22. Multiplier 22 receives an additional input from the duty cycle modulator 14 and performs its multiplication by interrupting the output from amplifier 20 at the duty cycle rate determined by the duty cycle modulator 14, as will be subsequently described. The output of the multiplier 22 is then applied to the conventional integrating circuit 24, the output from which is fed back to the second input terminal of the amplifier 20. The output of the integrator 24 is also connected to the output terminal 26 to provide the output signal, 1/t-V dt.

Figure 2:
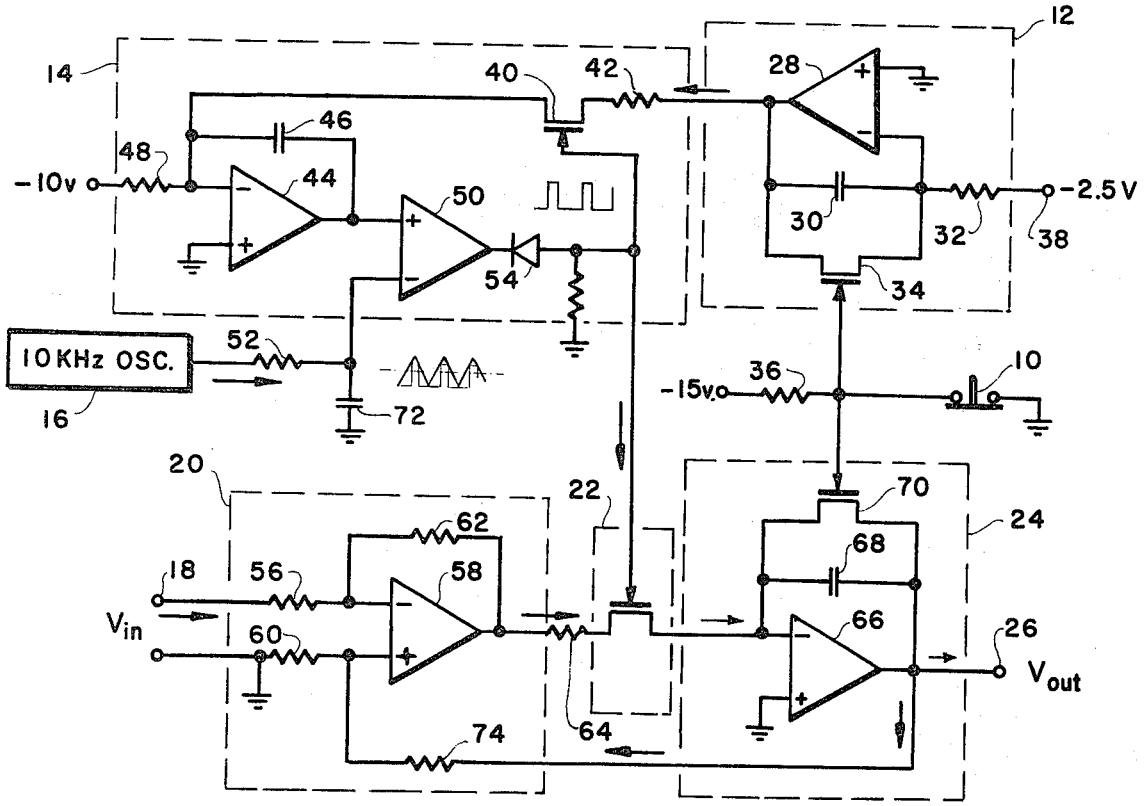
FIG. 2 is a schematic diagram of the circuitry of the invention.

FIG. 2 is a schematic diagram of the circuitry of FIG. 1 and illustrates the ramp generator 12 as comprising an operational amplifier 28 having a feedback capacitor 30 between the output terminal to the inverting input terminal, and with the non-inverting input terminal at ground potential. The inverting input terminal of amplifier 28 is also connected through a resistance 32 to a constant D.C. source of 2.5 volts. Capacitor 30 is shunted by an n-channel field effect transistor 34, the gate element of which is connected to ground through reset switch 10 and also to a negative voltage source through a resistance 36 having a value of approximately 1 megohm. Thus, while reset switch 10 is closed, transistor 34 is conductive to bypass the capacitor 30 and prevent the generation of a ramp voltage. However, when the reset switch 10 is open, a negative potential is applied to the gate of transistor 34, rendering it non-conductive and permitting the proper functioning of the ramp generator. The reset switch 10 is illustrated for clarity in FIG. 2 as being a manually operated, normally closed, single pole switch. In most applications the switch 10 would preferably be a J-FET analog switch electronically controlled, for example, by signals indicative of the respiratory cycles of a patient being monitored. Thus, the switch 10 may be opened, for example, at the start of the patient's inspiration and reset at the end of the inspiration of respiratory analyses of oxygen uptake, or at the end of expiration for carbon dioxide production data.

The ramp rate of ramp generator 12 is determined by the D.C. level at terminal 38, the value of the resistance 32, and that of capacitance 30. For use in pulmonary analyses previously described, a ramp rate of one-half volt per second is appropriate and may be obtained with the 2.5 volts input and with resistance 32 having a value of 1 megohm and capacitance 30 having a value of 5 microfarads. The output from ramp generator 12 may be defined as being equal to the value, Kt, wherein "K" is a constant determined by the D.C. conditions of the operational amplifier 28 and its associated components. Thus, the output signal from the generator 12 is proportional to time, t, and is applied to the duty cycle modulator 14.

The ramp generator output signal is applied to the modulator 14 through a field effect transistor switch 40 which, if desired, may be a CMOS analog switch. The signal is applied through the switch 40 and a resistance 42 to the inverting input of an operational amplifier 44 which may be a type 741 operating as a summing amplifier. The output of amplifier 44 is fed back through a capacitance 46 to the inverting input, and a negative D.C. voltage having a value of ten volts is applied through a resistance 48 having a value of 500 kilohms to the inverting input. The non-inverting input of the amplifier 44 is at ground potential. The output of operational amplifier 44 is applied to the non-inverting input of operational amplifier 50, which also may be a type 741. An oscillator 16, which provides a squarewave output at a frequency of approximately 10 KHz, is connected through a 10 kilohm resistance 52 and capacitor 72 forming an approximately triangular waveform at the inverting input of the amplifier 50. The output of amplifier 50 is coupled to the cathode of a diode 54, the anode of which is connected to the gate or the controlling element of the switch 40. Therefore, the output of the modulating operational amplifier 50 comprises a train of pulses having a frequency corresponding to that of the oscillator 16 but having on-to-off, or high-to-low level duty cycles controlled by the output of ramp generator 12.

If appropriate values are selected for resistance 42 and resistance 48, the duty cycle at the output of the amplifier 50 will be inversely proportional to time, t. The output of the duty cycle modulator 14 is proportional to the product of the duty cycle, D, and the ratio of the output of the ramp generator 12 to the value of resistance 42. The output signal is also proportional to the ratio of the D.C. input voltage of −10 volts to the resistance 48. Thus:

$$D\frac{V_{out}(28)}{R(42)} = D\frac{Kt}{R(42)} = \frac{-10v}{R(48)}$$

$$D = -10v\left(\frac{R(42)}{R(48)}\right)\left(\frac{1}{Kt}\right) = \text{Duty Cycle}$$

Values for resistance 42 and 48 can easily be selected so that D=1/t.

The voltage input signal representing an analog quantity, V, such as pulmonary gas flow, is introduced to the amplifier 20 through an input terminal 18. The input terminal 18 is coupled through a resistance 56 to the inverting input of an operational amplifier 58, which may be a type 741, the non-inverting input terminal of which is coupled to ground through a resistance 60. The output of amplifier 58 is fed back through a resistance 62 to the inverting input terminal. Resistances 56, 60, 62 and 74 are preferably equal in value, for example, each may have a value of 10 kilohms, and with such equal value resistance it can be shown that the voltage output level of amplifier 58 will equal the difference between the voltage level, $V_{out}$, at the output terminals 26 and the input signal, $V_{in}$, at input terminals 18.

The output terminal of the operational amplifier 58 is coupled through resistance 64 to the input of the multiplier 22, which may be an n-channel field effect transistor or analog CMOS switch operating at the frequency dictated by the duty cycle modulator 14 which, as previously explained, is proportional to the inverse of time, t. Thus, the output of the multiplier 22 will equal:

$$I_m = \frac{V_{out} - V_{in}}{R(64)t} = \frac{V_m}{R(64)t}$$

The output of multiplier 22 is applied to the integrator circuit 24 at the inverting input terminal of an operational amplifier 66. The output of amplifier 66 is fed back through a one microfarad capacitor 68 to the inverting input terminal and the non-inverting input terminal is grounded. Capacitor 68 is shunted with an n-channel field effect transistor, the gate element of which is connected to the reset switch 10 and to the gate of the transistor 34 in the ramp generator 12. When the reset switch 10 is opened, the negative voltage applied to the gate shuts off transistor 70 so that the amplifier 66 and its associated circuitry performs as an integrator to integrate the output signal of the multiplier 22. Thus:

$$V_{out} = \frac{1}{R(64)\,C(68)} \int V_m\,dt.$$

If the values of R(64) and C(68) are selected so that their product is one second, then:

$$V_{out} = \int \frac{V_{out} - V_{in}}{t}\,dt$$

By taking the derivative of both sides of the equation, rearranging the terms and integrating both sides of the equation, it can be shown that:

$$V_{out} = \frac{1}{t}\int V_{in}\,dt.$$

The output of the amplifier 66 is also fed back through a resistance 74 to the non-inverting input of amplifier 58 where it is isolated from ground by the resistance 60. This feedback from the output to the input amplifier serves to cancel the effects of errors that may be caused in the circuitry.

What is claimed is:

1. A circuitry for integrating with respect to time a signal representing an analog quantity while simultaneously dividing the integral by time, said circuitry comprising:

first circuitry means responsive to a first input signal for generating an output voltage having an amplitude proportional to the time duration of said input signal;

second circuitry means coupled to said first circuitry means and responsive to said output voltage for generating a cyclic output signal with high-to-low levels inversely proportional to the time duration of said first input signal;

an amplifier for receiving and amplifying a voltage signal representing the analog quantity to be integrated;

multiplier circuitry coupled to said amplifier and to said second circuitry means for multiplying the amplified analog voltage signal by said cyclic output signal;

and integrating circuitry coupled to said multiplier circuitry for integrating the product of said analog voltage signal and said cyclic output signal to produce an output signal of $1/t \int V\,dt$, wherein "V" is the analog voltage signal and "t" is the time duration of said first input signal.

2. The circuitry claimed in claim 1 wherein said first circuitry means comprises a ramp generator, the slope of the ramp voltage output being directly proportional to time, t.

3. The circuitry claimed in claim 2 wherein said second circuitry means comprises a duty cycle modulator responsive to said ramp voltage output of said ramp generator for modulating a fixed frequency into corresponding cyclic output signals with the duration of high and low output levels determined by the level of said ramp voltage, said cyclic output signals being proportional to the inverse of time, 1/t.

4. The circuitry claimed in claim 3 wherein said duty cycle modulator includes an output switch responsive to said cyclic output of said modulator for interrupting said ramp voltage generator output to said modulator in accordance with said cyclic output signals.

5. The circuitry claimed in claim 3 wherein said multiplier circuitry comprises a switch responsive to said cyclic output signals and interposed between the output of said amplifier and the input to said integrator for interrupting said amplified analog voltage signals to said integrator at said cyclic signal representing the value, 1/t.

6. The circuitry claimed in claim 5 wherein said integrating circuitry is responsive to said first input signal for integrating the product of said multiplier over the time duration of said first input signal.

* * * * *